United States Patent [19]

Zimmer

[11] 4,036,129

[45] July 19, 1977

[54] SQUEEGEE DEVICE

[76] Inventor: Johannes Zimmer, Ebentalerstrasse 133, 9020 Klagenfurt, Austria

[21] Appl. No.: 621,212

[22] Filed: Oct. 9, 1975

[30] Foreign Application Priority Data

| | | |
|---|---|---|
| Oct. 15, 1974 | Austria | 8277/74 |
| Aug. 25, 1975 | Austria | 6532/75 |

[51] Int. Cl.[2] ..... B41F 15/44

[52] U.S. Cl. ..... 101/120

[58] Field of Search ..... 101/115, 116, 119, 120

[56] References Cited

U.S. PATENT DOCUMENTS

| | | | |
|---|---|---|---|
| 2,753,794 | 7/1956 | Groak | 101/116 X |
| 3,796,153 | 3/1974 | Jaffa | 101/120 |
| 3,807,302 | 4/1974 | Kudlich | 101/120 X |
| 3,886,861 | 6/1975 | Anselrode | 101/120 X |

FOREIGN PATENT DOCUMENTS

| | | | |
|---|---|---|---|
| 266,757 | 11/1968 | Austria | 101/120 |
| 1,565,279 | 4/1969 | France | 101/120 |
| 1,923,116 | 11/1969 | Germany | 101/119 |

*Primary Examiner*—Edgar S. Burr
*Assistant Examiner*—R. E. Suter
*Attorney, Agent, or Firm*—Wenderoth, Lind & Ponack

[57] ABSTRACT

A squeegee roller rotates in contact with a surface to be treated. A sump of liquid or viscous material is upstream of the squeegee roller. A plate element has a seal in contact with the upstream side of the squeegee roller along the entire length thereof. A lowermost edge of the squeegee roller is spaced from the surface to be treated.

6 Claims, 8 Drawing Figures

SQUEEGEE DEVICE

BACKGROUND OF THE INVENTION

The present invention relates to a squeegee device of the type including a squeegee roller for applying a liquid or viscous material to a surface to be treated, in particular for the purpose of screen printing, and a profiled plate arranged in front or upstream of the area of the squeegee roller, the profiled plate forming a guide element for the coating material.

In a known device of this kind (see Austrian Pat. No. 315,800) the profiled plate is in the form of a known type of blade squeegee, so that the roller squeegee arranged behind or downstream thereof is merely employed for pressing the material applied by the blade squeegee into the surface to be treated.

On the other hand, in many printing devices it is necessary that a considerable amount of coating or printing material reach the front or upstream side of the squeegee roller. Until the present time this was always associated with the problem that since a thin squeegee roller can itself support or retain only a very limited aamount of coating material, it was necessary to provide the squeegee roller with a diameter greater than optimal for printing purposes. The capacity of the rotating roller to rotate a sump of coating material exceeding its own height, so that the material does not flow over the roller, is of only limited advantage in this connection. There is also the disadvantage that when the machine is stopped, the material flows into the area behind the squeegee roller, which causes defects in coating when the machine is again started.

Squeegees applied by magnetic pressure produce a completely uniform contact pressure, which is independent of the width of the work. The level of pressure is determined by the magnetic field, the intensity of which is adjustable, and by the available magnetizable mass of the squeegee. The coating roller is freely positioned within the screen or on the material to be colored or coated, and it can be replaced in a simple manner with a roller of a different diameter. The results of the coating operation can be varied by changing the contact pressure and by appropriately selecting the diameter of the squeegee roller. When the force with which the squeegee presses against the base is increased, the coating penetrates the material to a greater depth. A greater amount of coating material can be retained in front of a roller squeegee which has a greater diameter. Accordingly, such squeegees apply greater amounts per unit of surface.

The dependence of the contact pressure and also of the possible size of the sump of material in front or upstream of the squeegee on the diameter of the squeegee roller is a substantial hindrance when the required coating effect is to be obtained by means of roller squeegees of different diameter. Namely, due to the friction and the pressure of the liquid, the squeegee roller is forced from the center of the magnetic field, and in order to maintain the squeegee roller in the coating area, it is necessary to apply a magnetic pressure which is excessive for many kinds of material and coating effects. In order to attain such a contact pressure, a certain magnetizable mass is also required in addition to the field intensity. Accordingly, the use of small diameter roller squeegees is limited. These disadvantages cannot be entirely eliminated, even with the use of known damming plates arranged behind or downstream of the squeegee roller (see Austrian Pat. Nos. 266,024 and 306,750), since the rotating ink sump in front or upstream of the squeegee roller exerts a direct braking force on the squeegee roller and additionally presses against the damming plate with such a force that a braking effect also occurs due to contact between the roller and plate.

SUMMARY OF THE INVENTION

The above disadvantages are avoided in accordance with the invention by providing that the squeegee roller is pressed against the rear or downstream side of the profiled plate, which is spaced from the surface on which the squeegee roller rolls, the contact between the profiled plate and the squeegee roller being tight along the entire lenght of the squeegee roller, so that the coating material cannot pass upwardly between the profiled plate and the squeegee roller into the space above the squeegee roller.

The purpose of the profiled plate of this arrangement is to maintain the squeegee roller free from the pressure of the material sump which rotates in the direction of rotation of the squeegee roller on the front or upstream side of the plate. At the same time, the profiled plate, jointly with the squeegee roller, forms a seal which prevents the upward passage of the coating material into the space above the roller squeegee, which would be disadvantageous, particularly in the case of screen printing. The pressure exerted on the squeegee roller in the horizontal direction need only be sufficient to insure a satisfactory sealing effect between the profiled plate and the squeegee roller.

In order to overcome the prior art disadvantages, the present invention offers an additional advantage which is quite substantial especially for the printing art. The profiled plate can readily be formed in a shape which gives it the effect of a blade squeegee. The transition between a predominantly roller-squeegee effect of the proposed arrangement and a predominantly blade-squeegee effect thereof can then be realized by varying the setting angle of the profiled plate and the distance thereof from the rolling surface of the squeegee roller.

BRIEF DESCRIPTION OF THE DRAWINGS

The invention will be described in more detail below, with reference to the accompanying drawings, wherein.

DETAILED DESCRIPTION OF THE INVENTION

In the case of round-screen printing arrangements of the type described above, a screen 4 rotates at the speed of a blanket 10 or a web situated thereon, a frictional connection between screen 4 and blanket 10 being produced through the contact pressure of a squeegee roller 1. During operation, squeegee roller 1, applied in known manner by the pressure of magnets situated under blanket 10, presses a coating material 3, in particular a printing ink, through pattern-forming openings of screen 4, material 3 being fed into the interior of screen 4.

Figure 1:
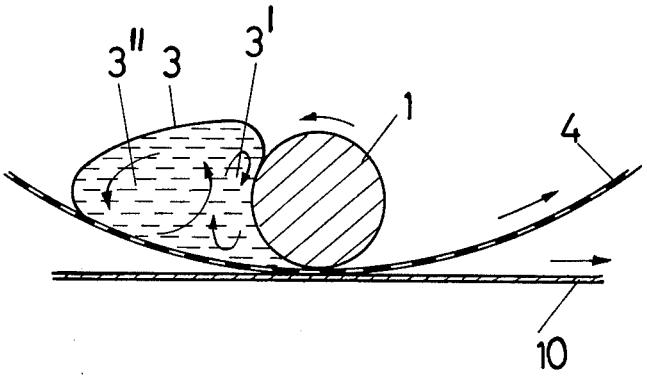
Fig. 1 PRIOR ART
FIG. 1 is a section through a prior art arrangement.

In the arrangement of FIG. 1, the sump of coating material 3 present in screen 4 exhibits under the effect of screen 4 the tendency of rotating in the same direction as the screen, such a tendency being intensified dependent upon the rotational velocity of screen 4 and the viscosity of coating material 3. In the area of contact with squeegee roller 1, this rotation of coating material 3, which is equidirectional with regard to screen 4, is opposed by the fact that squeegee roller 1 tends to take along a boundary layer 3' of coating material 3. Naturally, such a movement of boundary layer 3' in a direction of rotation which is opposite to the direction of rotation of main mass 3'' of coating material 3 leads to a retardation of rotation of squeegee roller 1. With an increase in the rotational velocity and viscosity of the sump of coating 3, boundary layer 3' becomes detached from squeegee roller 1, and the entire sump, which is then practically cylindrical, rotates equidirectionally with squeegee roller 1, i.e. counterclockwise as shown in FIG. 1, with roller squeegee 1 being possibly subjected to a strong braking effect.

Figure 2:
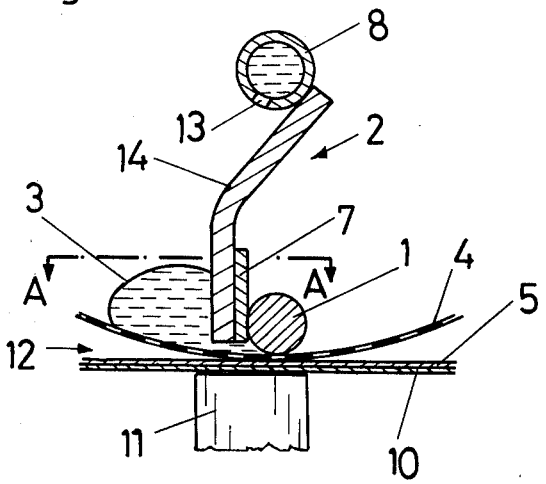
FIGS. 2–5 are similar sections of four exemplified embodiments of the invention.

In the arrangement of the invention shown in FIG. 2, there is provided a profiled element or plate 2, that consists of a main element 14 and a sealing strip 7 arranged on the rear or downstream side thereof. If screen 4 then rolls on a web 5 displaced with blanket 10 in a direction 12, the sump of coating 3 is subjected to a counterclockwise rotation, just as in the arrangement of FIG. 1. However, the sump in this arrangement is rotated on the front or upstream side of profiled plate 2, so that retardation of rotation of the squeegee roller 1 can largely be avoided.

Squeegee roller 1 is subjected to only a slight retardation by contact with sealing strip 7 consisting of an abrasion-proof, low-friction material. Squeegee roller 1 is pressed firmly against strip 7 so that in the area of contact therebetween no coating material 3 can pass in the upward direction. The application of squeegee roller 1 against sealing strip 7 can be effected, for example, mechanically through springs. However, in the case of a magnetically applied squeegee roller 1, it is substantially simpler to shift the plane of symmetry of a magnet bar 11, which presses the squeegee roller against the inner wall of screen 4, somewhat out of the line of contact between screen 4 and web 5 or from the vertical central plane of squeegee roller 1, so as to produce in this manner a horizontal component of the force that acts on squeegee roller 1. Squeegee roller 1 is thereby prevented by profiled plate 2 from moving into the central area of magnet 11. Profiled plate 2 can be supported on an ink tube 8, from which ink is discharged through openings 13, either in a swinging manner so that the established position of equilibrium is a function of the shape and weight of the profiled plate and the amount of coating 3, or alternatively profiled plate 2 can be rigidly attached to ink tube 8, whereby the position of plate 2 can be adjusted together with ink tube 8.

Figure 3:
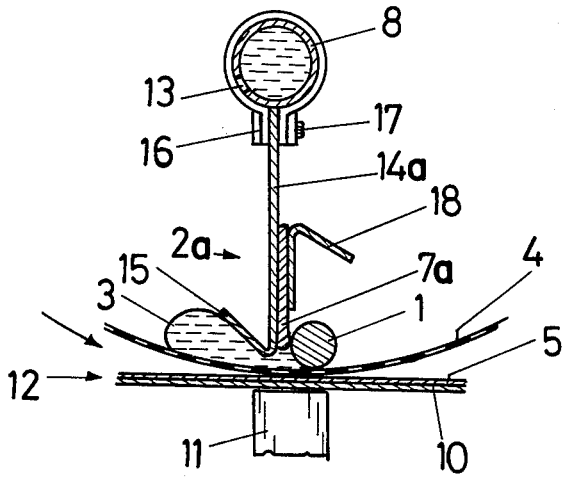

FIG. 3 shows a profiled plate 2*a* of a material that is resistant to bending, the main element 14*a* thereof carrying at the lower portion thereof a sealing strip 7*a* just as in the arrangement of FIG. 2. Sealing strip 7*a* contacts squeegee roller 1 in sealing manner, so that the coating material connot overflow into the area above squeegee roller 1.

Element 14*a* of plate 2*a* has at the lower end thereof a bent damming section 15 extending into the area of sump 3 in front or upstream of squeegee roller 1. The liquid pressure of coating material 3 can be adjusted through the use of profiled plates having sections 15 that possess differing widths and that are bent at differing angles. Profiled plates which extend further against the direction of displacement 12 and which define a flatter or narrower angle with round screen 4 produce a higher pressure within material 3, and, therewith a greater amount of material passing through screen 4 onto web 5.

Profiled plate 2*a* is attached to ink feed tube 8 by a clamping device 16 including a clamping screw 17. The ink tube is provided with openings 13 through which substance 3 can flow into the area in front of squeegee roller 1. An attachment 18 on profiled plate 2*a* makes it possible to insert and remove squeegee roller 1 jointly with the coating device, if the device is turned during this by about 180° in the direction of movement of the round screen.

Figure 4:
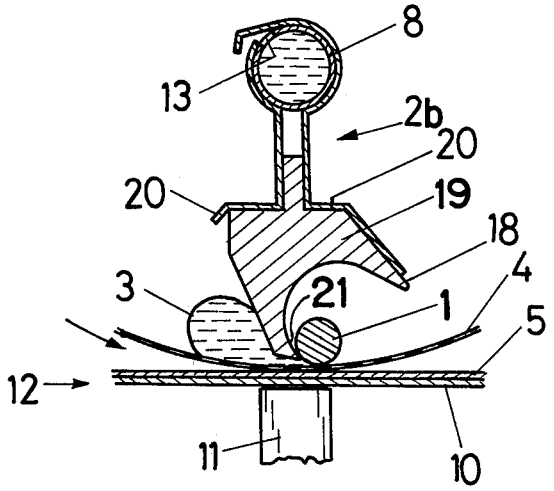

FIG. 4 shows an embodiment of the invention wherein profiled plate 2*b* consists of a profiled section 19 and strips of material 20 which simultaneously form the clamping device or support for section 19 and the clamping arrangement for supporting section 19 on ink feed tube 8.

Section 19 contacts squeegee roller 1 with a surface 21 and is elastic at least in such area. Toward the squeegee roller, section 19 of profiled plate 2*b* is curved concavely and forms extension 18 for receiving squeegee roller 1 during the insertion and removal of the coating device.

Figure 5:
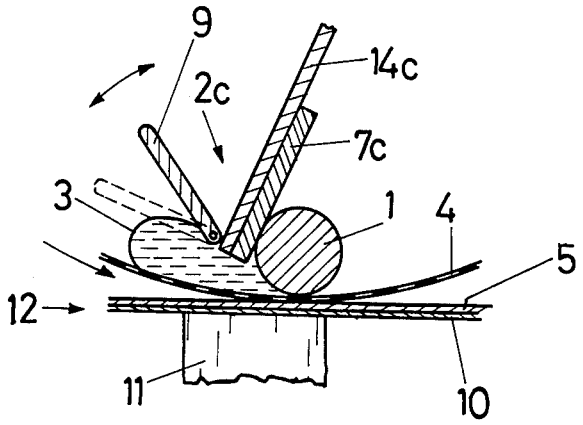

FIG. 5 shows an embodiment of the invention wherein a baffle 9 is pivotally supported on main element 14*c* of profiled plate 2*c*, the purpose being similar to that of element 15 of FIG. 3, i.e. to provide profiled plate 2*a* with a damming section. In this arrangement, the setting of various angles of the damming section is much simplified.

Figure 6:
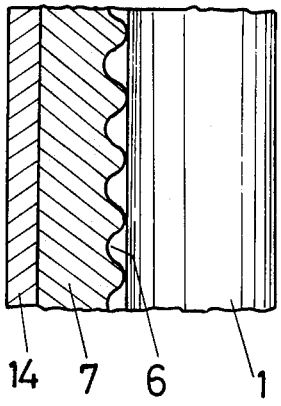
FIGS. 6 and 7 are sections taken along line A—A of FIG. 2 of two different sealing strips.
Figure 7:
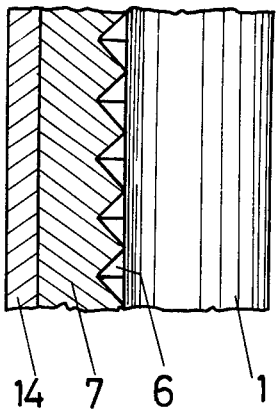

During initial experiments carried out with the arrangement of the invention, it was observed that occasionally an excessive contact pressure between squeegee roller 1 and sealing strip 7 would lead to an accumulation of ink in the gap existing above the area of contact between squeegee roller 1 and sealing strip 7. This paradoxical phenomenon is explained by the fact that a thin film of material 3 is carried on squeegee roller 1 and is removed at the sealing edge thereof with strip 7. This observed disadvantage may be eliminated, on the one hand, by forming sealing strip 7 of elastic material and, on the other hand, by forming the sealing strip 7 in the manner shown in FIGS. 6 and 7. The sealing strip 7 shown in FIG. 6 has grooves 6 therein in the area of contact with squeegee roller 1. Such grooves are dimensioned to prevent an upward penetration of coating 3 while allowing a downward movement of the thin film of coating adhering to squeegee roller 1. Providing the grooves 6 with downwardly decreasing depths, as shown in FIG. 7, is particularly advantageous to achieve this result.

Figure 8:
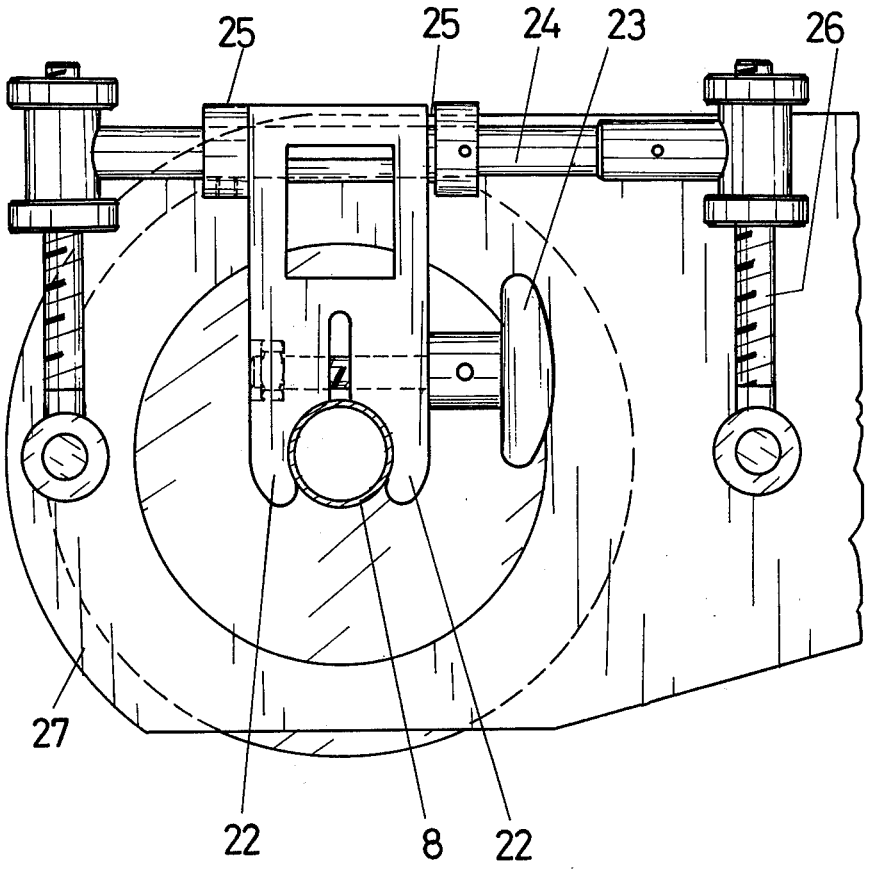
FIG. 8 is an elevation showing one manner of adjusting the ink tube which carries the profiled plate.

FIG. 8 shows a preferred arrangement for adjusting the position of the ink feed tube 8 which carries profiled plate 2 of the invention. Ink feed tube 8 is carried by clamps or jaws 22, that can be tightened or loosened by means of a handle 23. When jaws 22 are loosened, ink feed tube 8 can be turned together with profiled plate 2. Jaws 22 are displaceably mounted along a horizontally extending rod 24 and can be fixed thereon by means of sleeves 25. Rod 24 can be displaced vertically along threaded bolts 26 that are attached to a base plate 27 of the round screen.

As shown in FIGS. 2 and 4, the lowermost edge of elements 14 and 19, respectively, may extend beyond the rotational axis of the squeegee roller toward the surface to be treated.

I claim:

1. In a system for applying a liquid or viscous material to a surface to be treated, the system being of the type including a squeegee roller displaceable toward the surface to be treated and rotatable in the direction of movement thereof, a sump of liquid or viscous material positioned on the upstream side of said squeegee roller with respect to the direction of movement of the surface, and a feed tube positioned to supply said material to said sump; the improvement comprising:

a plate element extending from said feed tube and supported thereby at a position to contact said upstream side of said squeegee roller;

said plate element extending along the entire length of said squeegee roller;

said plate element having thereon seal means to prevent passage of said liquid or viscous material from said sump wardly between said plate element and said squeegee roller;

and a lowermost edge of said plate element being positioned to extend beyond the rotational axis of said squeegee roller toward the surface to be treated and spaced from such surface;

whereby said plate element thus positioned prevents said sump from retarding rotation of said squeegee roller.

2. The improvement claimed in claim 1, wherein said seal means comprises a separate strip attached to said plate element and formed of an elastic low-friction material.

3. The improvement claimed in claim 1, further comprising means for vertically and horizontally adjusting the position of said plate element.

4. In a system for applying a liquid or viscous material to a surface to be treated, the system being of the type including a squeegee roller displaceable toward the surface to be treated and rotatable in the direction of movement thereof, and a sump of liquid or viscous material positioned on the upstream side of said squeegee roller with respect to the direction of movement of the surface; the improvement comprising:

a plate element positioned to contact said upstream side of said squeegee roller;

said plate element extending along the entire length of said squeegee roller;

a lowermost edge of said plate element being positioned to be spaced from the surface to be treated;

and said plate element having thereon seal means to prevent passage of said liquid or viscous material from said sump upwardly between said plate element and said squeegee roller, said seal means having therein, in the area of contact with said squeegee roller, plural grooves extending approximately at right angles to radii of said squeegee roller passing through said area of contact.

5. The improvement claimed in claim 4, wherein the size of said grooves decreases in a direction toward said lowermost edge of said plate element.

6. In a system for applying a liquid or viscous material to a surface to be treated, the system being of the type including a squeegee roller displaceable toward the surface to be treated and rotatable in the direction of movement thereof, and a sump of liquid or viscous material positioned on the upstream side of said squeegee roller with respect to the direction of movement of the surface; the improvement comprising:

a plate element positioned to contact said upstream side of said squeegee roller;

said plate element extending along the entire length of said squeegee roller;

a lowermost edge of said plate element being positioned to be spaced from the surface to be treated;

said plate element having thereon seal means to prevent passage of said liquid or viscous material from said sump upwardly between said plate element and said squeegee roller;

and a baffle plate pivotally connected to a lower portion of said plate element and extending therefrom in an upstream direction into said sump.

* * * * *